United States Patent [19]

Mitchell et al.

[11] 4,145,822

[45] Mar. 27, 1979

[54] SCUFF-TYPE SLIPPER

[76] Inventors: Winalee G. Mitchell; James G. Mitchell, both of Principle Business Enterprises, Inc., Pine Lake Industrial Park, Perrysburg, Ohio 43414

[21] Appl. No.: 849,681

[22] Filed: Nov. 8, 1977

Related U.S. Application Data

[63] Continuation-in-part of Ser. No. 772,791, Feb. 28, 1977, abandoned.

[51] Int. Cl.[2] ..... A43B 1/14; A43B 1/02; A43B 3/10; A43B 9/00

[52] U.S. Cl. ..... 36/87; 36/9 R; 36/10; 12/142 R; 152/252

[58] Field of Search ..... 36/9 R, 10, 87, 83, 36/102, 7.1 R, 7.3, 4; 12/142 R, 142 E, 142 EV, 142 G; 152/250–253; D2/272

[56] References Cited

U.S. PATENT DOCUMENTS

| | | | |
|---|---|---|---|
| Re. 28,563 | 9/1975 | Mitchell et al. | 156/252 |
| 3,273,185 | 9/1966 | Winson et al. | 12/142 R |
| 3,311,937 | 4/1967 | Conroy | 12/142 R |
| 3,426,454 | 2/1969 | Mitchell et al. | 36/87 |
| 3,523,378 | 8/1970 | Mitchell et al. | 36/87 |

*Primary Examiner*—Patrick D. Lawson
*Attorney, Agent, or Firm*—Pollock, Vande Sande & Priddy

[57] ABSTRACT

The disclosure describes various forms of scuff-type slippers which are durable and resist turning under of the heel portion in use. These include a transversely elastic vamp, a sole which can be bent transversely by tension forces in the vamp, to which it is fusion bonded, and, extending above the sole, a heel overlayer that is secured to the sole at least in part by fusion bonding along the sides thereof. Also disclosed are methods of making such slippers.

42 Claims, 20 Drawing Figures

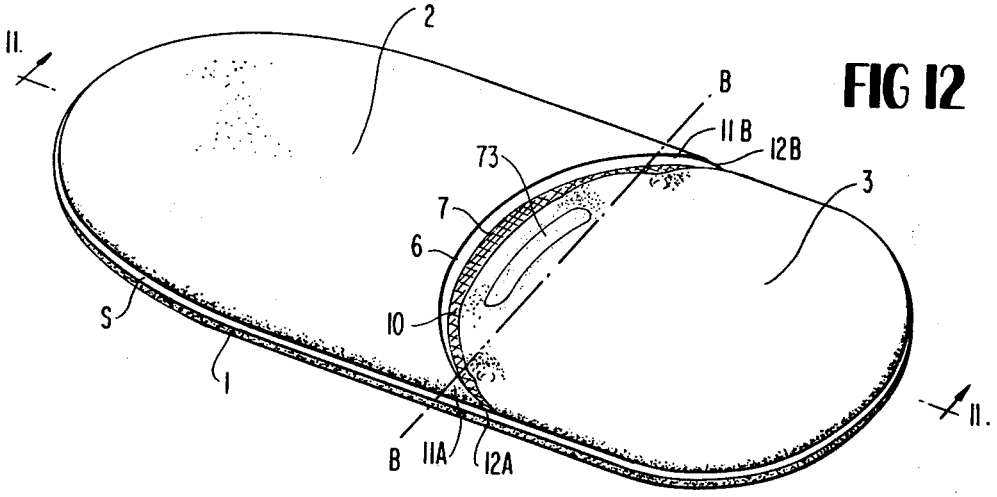
FIG 12
FIG 13
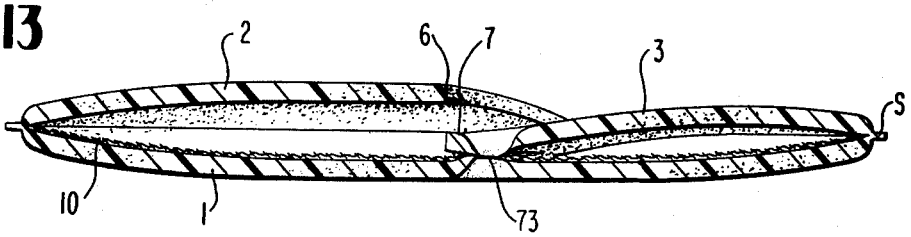

SCUFF-TYPE SLIPPER

REFERENCE TO RELATED APPLICATION

This application is a continuation-in-part of our prior copending U.S. Patent Application Ser. No. 772,791 filed Feb. 28, 1977, which is now abandoned.

BACKGROUND OF THE INVENTION

Scuff-type slippers are known. The fact that they do not include an upstanding heel structure, which is provided in other slippers to keep them in place on the wearer's foot, decreases their manufacturing cost. When scuff-type slippers are fabricated with sufficiently limited quantities of inexpensive materials so they can reasonably be regarded as "disposable", comfort is sometimes lacking, and tearing apart in use has been a problem. Also, the lack of an upstanding heel portion, coupled with the restricted quantity of raw material, has generally resulted in the slippers having an annoying tendency for the heel portion to fold under in use, thus discouraging consumer acceptance.

It appears that many of the available forms of scuff-type slippers achieve economy at the expense of comfort, durability and resistance to folding under. On the other hand, other available forms of scuff-type slippers which do achieve substantial measures of comfort, durability, and resistance to turning under, involve substantially greater costs for raw materials and fabrication. Accordingly, a need remains for a comfortable scuff-type slipper which can be manufactured inexpensively, and yet has practical durability and substantial resistance to folding under of the heel portion.

SUMMARY OF THE INVENTION

It has been found that the foregoing need can be met with a scuff-type slipper, the shape of which changes elastically between a wearing position and a non-wearing position. In wearing position the slipper is stretched elastically in a plane perpendicular to the slipper longitudinal axis to conform to the instep of the wearer's foot, and has no heel structure extending up the rear of the wearer's heel. As compared to its wearing position, the slipper is relatively flattened and contracted in non-wearing position.

The sole has front, side and rear edges which in combined outline approximate the outline of the human foot. The sole is of a material which has longitudinal flexibility and is sufficiently pliant in longitudinal bending, that it would be susceptible to turning under of its rear portion when in use. Also, the sole has sufficient width and transverse pliant flexibility, that it is capable of bending upwardly at the sides of the wearer's instep on both sides of the slipper.

The slipper also includes a heel overlayer. It extends forwardly from adjacent the heel of the slipper over the upper surface of the sole for about one fourth to about one half the total distance from the heel to the toe of the slipper, measured along its longitudinal axis. The overlayer has rear and side edges and a transverse leading edge. The overlayer is joined to the sole at least along and adjacent to the side edges of the sole and overlayer by a fusion bonded seam. The transverse leading edge extends to an intersection with said seam at each side of the slipper. Like the sole, the overlayer has sufficient transverse pliant flexibility, that it is capable of bending upwardly at its lateral edges.

Also included in the scuff is a vamp which extends rearwardly from adjacent the toe of the slipper to a position which is about one half of the way from the toe to the heel of the slipper, measured along its longitudinal axis. The vamp has front and side edges and a transverse trailing edge. Such vamp is joined to the sole at least along and adjacent to the side edges of the sole and overlayer by a fusion bonded seam. The trailing edge of the vamp extends to an intersection with the fusion bonded seam at the sides of the slipper. Because all or most of the trailing edge is free of attachment to the sole, an opening is provided for insertion of the wearer's foot.

The vamp is pliantly elastic transversely, and preferably also along its trailing edge, to develop, when stretched by insertion of the wearer's foot, an internal elastic tension in the vamp having an upward and inward transverse component of force which is transmitted to the sole and heel overlayer through the fusion bonded seam. The thickness and modulus of elasticity in tension of the vamp material are sufficient to cause lifting of the side edges of the sole above the upper surface of the sole along its longitudinal axis. This induced curvature of the sole in a plane perpendicular to the slipper axis in the vicinity of the wearer's instep, which curvature may, in preferred embodiments, also be induced in the heel overlayer, dramatically increases the stiffness of the slipper against longitudinal bending, and is therefore useful in reducing the tendency of the rear portion of the slipper to fold under in use.

Certain optional and preferred features may be added to the foregoing to further increase the comfort, durability, resistance to turning under or other worthwhile attributes of the slipper. For example, the above-mentioned position to which the vamp extends is defined by its trailing edge, and it is preferred that the position of the vamp trailing edge be more than about one half to about three quarters of the distance from the toe to the heel of the slipper. If the trailing edge is a straight line perpendicular to the slipper longitudinal axis, the said position is the simple distance from the toe to the trailing edge. But the trailing edge need not be a straight line. In fact, it is preferred that at least the outer portions of the trailing edge, viewed from above with the slipper flattened, extend rearwardly and outwardly to its intersections with the seam. In such case, the position is determined by taking the mean of the distances from the toe to (a) the forward-most and (b) the rear-most projections of the trailing edge. Preferably, the rear-most projection will correspond to one or both of the above-mentioned intersections. More preferably, the said outer portions intersect with the seams at an acute angle to inhibit tearing of the vamp, sole or seam in the vicinity of said intersections.

It is particularly advantageous and preferred that the vamp and heel overlayer be formed from portions of the same piece of material. It strengthens the slipper if the said portions are not severed from one another in the side seams which connect the vamp and heel overlayer to the sole of the slipper. Moreover, the slipper is more conveniently manufactured if the vamp trailing edge and heel overlayer leading edge are configured so that they substantially coincide with one another when the slipper is flattened in non-wearing position.

For reasons of strength and simplicity of construction, it is preferred that a common seam join the vamp and heel overlayer to the sole on the right side of the slipper, and that a common seam join the vamp and heel overlayer to the sole on the left side of the slipper. It is also preferred to join by a fusion bonded seam either the front edges of the sole and vamp, or the rear edges of the sole and heel overlayer, or both of the foregoing. The left common seam, right common seam, front edge seam, and rear edge seam may be separate or combined seams. Preferably, the sole, vamp and heel overlayer are joined by one seam extending around the entire periphery of the slipper, which seam may be discontinuous so as to resemble stitching, but is preferably a substantially continuous heat seal of crushed, coalesced material around substantially the entire periphery.

The heel overlayer is usually secured to the sole only at the periphery of the over-layer, but connection of these parts inside such periphery is also permissible. Preferably, the entire periphery of the sides and rear of the heel overlayer is fusion bonded to the sole. In a particularly preferred form, the fore portion of the heel overlayer is secured to the upper side of the sole for bracing the heel portion of the slipper against bending under. When at least the outer portions of the vamp trailing edge extend outwardly and rearwardly to their intersections with the side seams, it is advantageous if the fore portion of the heel overlayer is secured to the sole by connecting means forward of a line connecting said intersections.

A preferred connecting means for securing the fore portion to the sole is one or more fusion bonds along the heel overlayer leading edge. In a preferred embodiment the connecting means is a band, such as a bar seal, at the center of said leading edge, traversing up to about ½ and preferably about ⅓ or less of the width of the slipper. In an alternative preferred embodiment, the connecting means is a plurality of bonds, i.e. discrete areas of crushed coalesced material distributed along a line drawn through said areas from one side of said slipper to the other, the remainder of the material along said line being uncrushed, uncoalesced, material, and the amount of crushed, coalesced material along said line being an amount, up to about 50% of the total material along said line, which is sufficient to maintain integrity of said bonds during normal use of said slipper.

A further and highly important advantage of the slipper product of the present invention is its susceptibility to economical production methods in which the vamp and heel overlayer can be formed from a common sheet of material. These methods are considered to be part of the invention, and, in a generic sense, they include the following steps: (A) providing a first sheet of fusion bondable polymeric sheeting material from which is to be formed a vamp and a heel overlayer; (B) providing a second sheet of fusion bondable polymeric sheeting material from which is to be formed a sole that is to be united with the vamp and heel overlayer to form an elongated slipper having a toe, a heel, and a longitudinal axis extending therebetween; (C) forming a cut in said first sheet of material transverse to said longitudinal axis for defining the trailing edge of the vamp; (D) forming a cut in said first sheet transverse to said longitudinal axis for defining the forward edge of the heel overlayer; (E) bringing said first and second sheets together in face-to-face relationship; (F) in a sealing operation, exerting firm pressure on the exposed faces of said sheets in at least one narrow region, having an elongated outline generally conformable to the human foot, said outline being elongated in the direction of said longitudinal axis and generally transverse to the said cut or cuts, said cut or cuts extending to said region; (G) raising the temperature of said sheets within said region to the temperature at which said sheets will adhere to one another within said region, and maintaining said temperature for a time sufficient to ensure the formation of a permanent bond between said sheets in said region; and (H) separating a slipper from material lying outside of said region.

The products have the further advantage that they lend themselves well to automatic mechanized production operations, which constitute a preferred specie of the above method including: (A) providing said first sheet in the form of an elongated strip of thermoplastic material; (B) providing said second sheet in the form of an elongated strip of thermoplastic material; (C) advancing said first strip of material in the direction in which it is elongated through a means for forming cuts oriented longitudinally relative to the strip at intervals which are spaced longitudinally along said strip for defining the trailing edges of the vamp portions of the slippers; (D) advancing said first strip of material in the direction of its elongation through a means for forming cuts oriented longitudinally relative to the strip axis at intervals which are spaced longitudinally along said strip for defining the forward edges of the heel overlayer portions of the slipper; (E) forming said cuts at equally spaced intervals of length along said strip; and (F) bringing said first and second strips into face-to-face contact with one another and advancing them longitudinally and together into said sealing operation.

Certain optional added features may be applied either to the generic method or the mass production specie described in the preceding paragraphs, thereby making additional contributions to product durability and/or the economical fabrication thereof. For instance, the method lends itself well to forming the vamp trailing edge and heel overlayer leading edge simultaneously either with a single cut or with two spaced apart cuts made simultaneously. Thus the said trailing and leading edges may or may not coincide, although forming them both from a single cut and causing them to coincide in the completed slipper is preferred. Accordingly, steps (A) and (B) of either of the foregoing methods may be performed by a single cutting implement. Another optional feature of these methods is terminating the above-mentioned cut or cuts at the inner edge of the aforesaid region, so that the cut or cuts do not traverse said region. This produces a slipper in which there is continuity of the material of the heel overlayer and that of the vamp in said region. Such slippers have superior resistance to tearing as compared to slippers in which the cuts traverse said region, notwithstanding the fact that the separate vamp and heel overlayer of the latter slippers are both fusion bonded to the sole. The method also lends itself well to securing the fore portion of the heel overlayer to the upper surface of the sole simultaneous with the formation of that fusion bond which unites the vamp and heel overlayer to the sole, e.g. one may use a sealing die which includes die lands for forming the peripheral seam of the slippers and additional die lands for performing the securing function, thereby eliminating any need for separate securing equipment or steps.

BRIEF DESCRIPTION OF THE DRAWINGS

FIG. 12 is a perspective view of still another embodiment of the slipper of the invention.

FIG. 13 is a vertical section of the slipper taken along section line 13—13 of FIG. 12.

DESCRIPTION OF PREFERRED EMBODIMENTS

Figure 1:
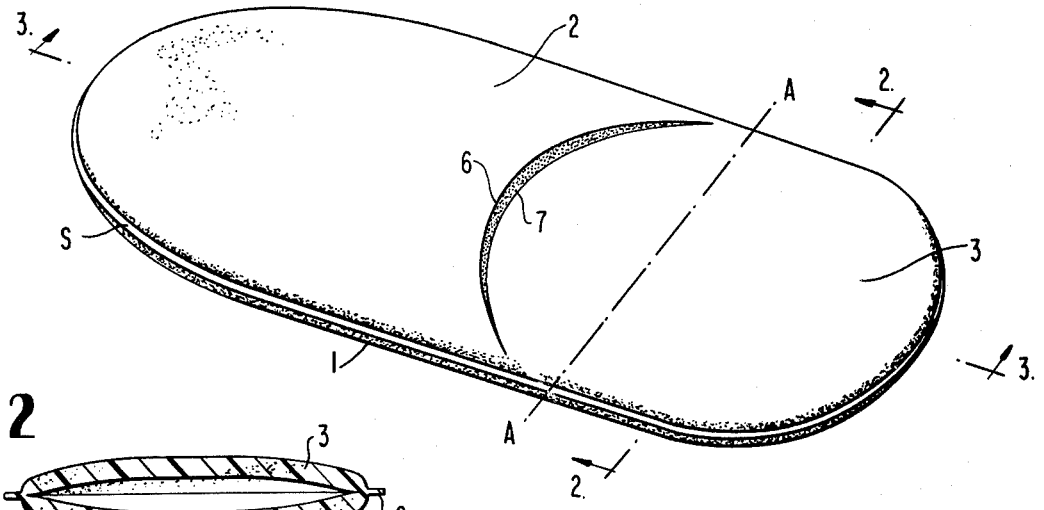
FIG. 1 is a perspective view of a slipper in accordance with the present invention in non-wearing position.
Figure 2:
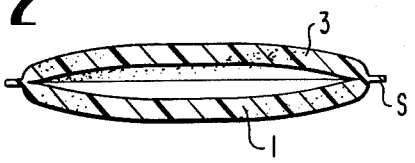
FIG. 2 is a vertical section of the slipper taken along section line 2—2 of FIG. 1.
Figure 3:
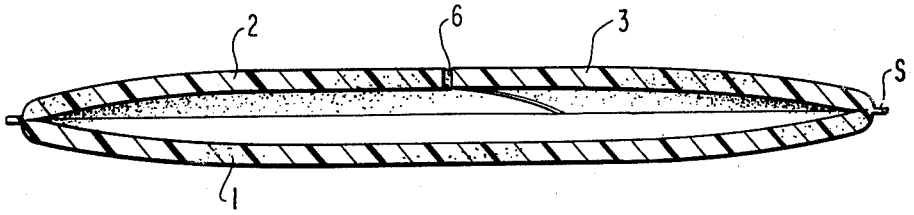
FIG. 3 is a vertical section of the slipper taken along section line 3—3 of FIG. 1.

An embodiment of the slipper invention is shown in FIGS. 1 - 3. It includes a sole 1, heel overlayer 3, and vamp 2, sometimes referred to as an "upper", which assists in retaining the slipper on the wearer's foot. Each of these components may be fabricated of different material. However, in this preferred embodiment, all three components are of the same material. The preferred material is a pliant, flexible, and elastic polymeric foam, a particularly preferred example of which is polyurethane foam, which is ordinarily prepared by blowing and curing a polyester or polyether resin with a diisocyanate or other blowing and curing agents or processes. While elastomeric materials are considered desirable, there is no intention of excluding those materials which exhibit a temporary or slight compression set, and polyurethanes based on polyesters are considered to give the best results.

The respective front, side and rear edges of the sole, vamp, and heel overlayer preferably have similar shapes and most preferably the same shape. Their shape, as combined, should be conformable to the human foot, i.e. should conform closely enough to that of the human foot so that the elasticity of the material will be sufficient to compensate for differences between the outlines of the slipper and the foot, if any. The oval shape shown in FIGS. 1 - 3 will fit either the left or right foot equally well, but other shapes may be used.

The heel overlayer 3, as shown, is in an appropriate position so that it will be beneath the wearer's heel when the slipper is worn, and has a leading edge 7. The overlayer is secured to the sole 1 at least in part by the fusion bonding along the sides of the sole. Overlayer 3 is preferably secured to sole 1 only at the periphery of the overlayer, and preferably by fusion bonding with seam S along both the side and rear edges of the overlayer and sole.

The vamp 2, as shown, is in an appropriate position so that it will be above the wearer's instep when the slipper is worn, and has a trailing edge 6. The vamp is secured to the sole at least in part by fusion bonding along the sides of the sole. The vamp is preferably secured to sole 1 only at the periphery of the vamp, and preferably by fusion bonding with seam S along both the side and front edges of the vamp and sole.

Figure 4:
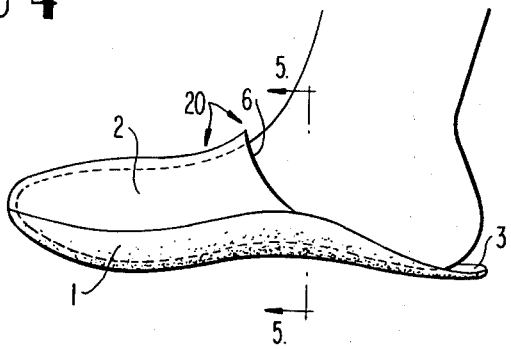
FIG. 4 is a side elevation of the slipper of FIG. 1 in wearing position.

The length, width, and elasticity of vamp 2, coupled with the characteristics of sole 1 and overlayer 3, help to resist folding under of the slipper during use. The width of the sole and vamp at the instep are made small enough, in non-wearing position, so that the average wearer's instep can stretch at least the vamp, and preferably also the sole, transversely. Vamp 2 has a trailing edge 6 and preferably extends far enough to the rear of the scuff to cover the major portion of the wearer's instep 20. See FIG. 4. When the wearer's foot is inserted, as shown in FIG. 4, the length of vamp 2 causes the vamp to be lifted and stretched by instep 20, exerting upward and inward force on the side edges of sole 1.

Figure 5:
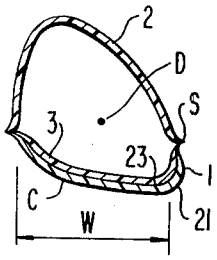
FIG. 5 is a vertical section taken along section line 5—5 of FIG. 4.
Figure 6:
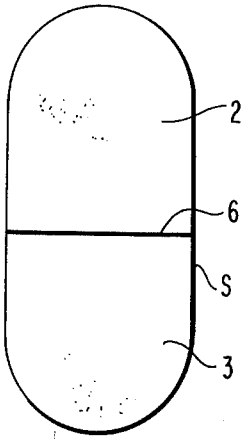
FIGS. 6 through 9 are schematic diagrams of slippers in accordance with the invention showing some of the possible alternate forms of the vamp trailing edge.

In FIG. 5 the slipper is drawn as though the wearer's foot were in place, but the foot is omitted from the view. As shown in FIG. 5, sole 1 is preferably made in such a way, so that that portion of it which underlies the instep is, when in wearing position — and measured over the outer surface 21 of the sole from one side of seam S to its other side — stretched to a width wider than the downwardly projected width W of the average wearer's bare instep. The upward rise of the vamp at the wearer's instep, tugging on the sides of the sole through the sides of the vamp, causes a substantial portion of the length of the sole to conform at least partially with the wearer's foot and to form a curve C about longitudinal axis D. The portion of length which is so curved traverses that region of the sole which tends to fold under, e.g. in the vicinity of the instep. The curve of sole 1 will be visible in a plane passing through said region perpendicular to the slipper longitudinal axis and in parallel planes both in front of and behind the firstmentioned plane, although the curvature will not necessarily be the same in all planes. In this curved condition, as shown in the transverse cross sectional view FIG. 5, the side edges of the sole are raised above the upper surface 23 of the central portion of the sole which is beneath the foot. This tends to increase the resisting to flexing of the sole, as compared to its flexing resistance when in a planar condition, thus increasing the resistance of the sole to folding under in use.

Figure 7:
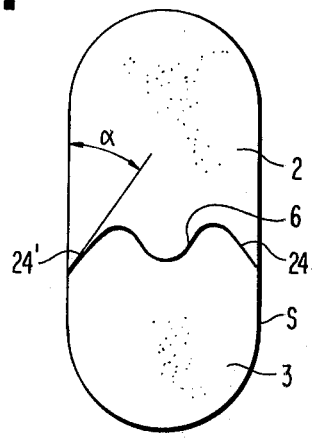
Figure 8:
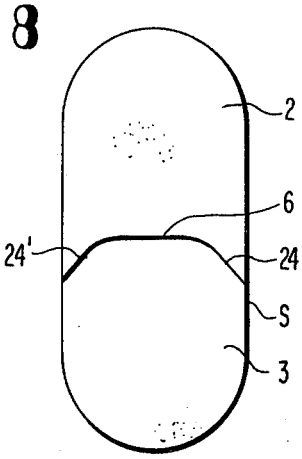
Figure 9:
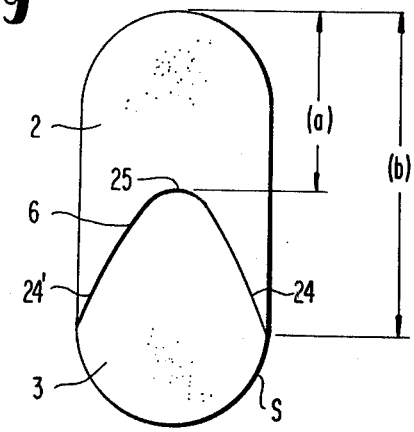

The shape of the vamp trailing edge 7 may be varied. A number of examples appear in FIGS. 6 through 9, which show, respectively: straight, reverse curve, segmented (including straight line segments joined by curved segments) and elongated-curved trailing edges 6. Preferred are those embodiments, as illustrated by FIGS. 7, 8 and 9, in which at least the outer portions 24 and 24' of trailing edge 6 extend outwardly and rearwardly as they approach intersection with seam S. This provides an acute angle intersection, illustrated by angle $\alpha$ in FIG. 7, between vamp trailing edge 6 and seam S. For best results, the angle $\alpha$ should be in the range of about 10° to about 80° and preferably about 30° to 60° measured with the slipper flattened in non-wearing position.

In the embodiment of FIG. 9, the center 25 of vamp trailing edge 6 is less than half the distance from the toe to the heel of the slipper, but the mean of the distances from the toe to the foremost projection (a) and the rearmost projection (b) of the trailing edge is more than half the distance from the toe to the heel. However, for best results, it is advantageous if the center of the trailing edge of the vamp extends far enough to the rear to cover most of the wearer's instep, e.g. from about ½ to ⅔ of the distance from the toe to the heel, while the intersections between the trailing edge of the vamp and seam S are preferably to the rear of the center portion of the trailing edge, e.g. up to about ¾ of the distance from the toe to the heel. The foregoing includes the most preferred configuration of trailing edge 6, which is the continuous concave curve shown in FIGS. 1 and 10.

Preferably, vamp trailing edge 6 approaches but does not overlie the leading edge 7 of heel overlayer 3. Accordingly, the vamp and overlayer can, when desired, be made from the same sheet of plastic material. This makes possible a particularly preferred embodiment in which the same transverse cut is used to form both the vamp trailing edge and overlayer leading edge. Still more preferably, the vamp trailing edge, viewed from above with the slipper flattened in non-wearing position, substantially coincides with the overlayer leading edge. Accordingly, when the vamp trailing edge is a concave curve, the overlayer leading edge is a complementary convex curve. However, the trailing edge and leading edge can be formed by separate cuts if desired.

Figure 10:
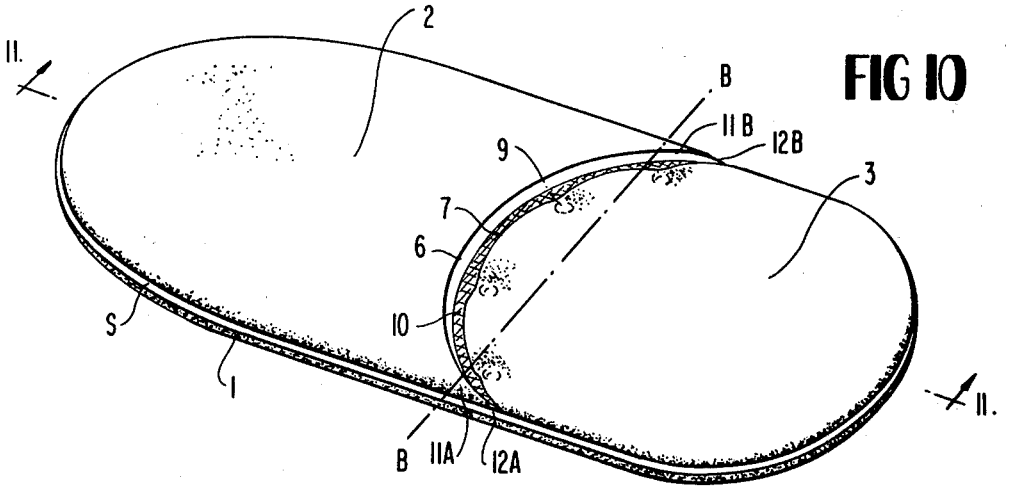
FIG. 10 is a perspective view of another embodiment of the slipper of the invention.
Figure 11:
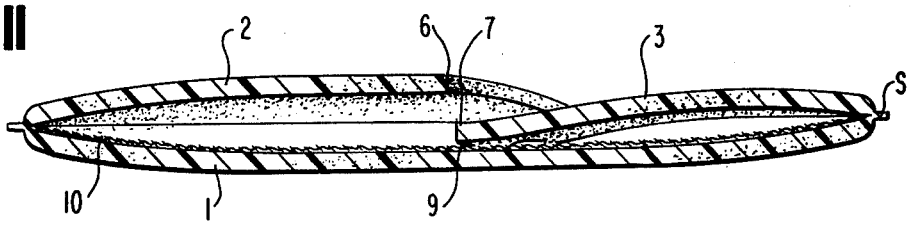
FIG. 11 is a vertical section of the slipper taken along section line 11—11 of FIG. 10.

FIGS. 10 and 11 illustrate a slipper similar to that shown in FIGS. 1 - 3, but having the fore-portion of overlayer 3 secured to sole 1, preferably adjacent to overlayer forward edge 7. This provides additional resistance to bending under of the heel portion. In the FIG. 1 embodiment, which lacks such securing, the flattened slipper tends to bend on bending line A—A, which extends across overlayer 3 over the intersections of vamp trailing edge 6 with seam S on both sides of the slipper. This bending line is also believed to indicate the approximate location where the slipper has its most pronounced tendency to fold under in use. The front portion of overlayer 3 can be secured to sole 1 rearwardly of bending line A—A. However, it is preferred that they be secured forwardly of line A—A (in the direction of the front of the slipper), to provide more effective bracing against folding under, as compared to the bracing which would be obtained were the parts secured to one another rearward of the bending line. This tends to shift the bending line of the slipper, when in flattened position, to bending line B—B in FIG. 10. It is believed that this causes the small triangular sections 11A and 11B of vamp 2, which are respectively between intersections 12A and 12B and bending line B—B, to act, in combination with the remainder of the vamp, to resist bending under.

If the securing referred to in the preceding paragraph is done by fusion bonding, whereby the plastic material is crushed and coalesced in the resultant bond, it is possible to use a single continuous bond extending across substantially the entire leading edge 7. However, we have found it possible to provide significantly better bending resistance in the slippers if the leading edge is not bonded across the entire width of the slipper. More specifically, assuming there are one or more bonded areas along the leading edge 7 for securing the heel overlayer to the sole, and that an imaginary line extends through said areas from one side of the slipper to the other, there should be a substantial amount of uncrushed, uncoalesced or unbonded material along said line. In general the amount of bonded or crushed and coalesced material along said line should be an amount which represents up to about ½, or preferably about ⅓, or less of the total amount of material along said line, said amount being sufficient to maintain integrity of said bonds during normal use of said slipper. A convenient example of the foregoing is the use of spaced dots 9 which generally follow the curve of overlayer forward edge 7 in FIG. 10.

The most preferred mode of securing the heel overlayer forward edge is illustrated in FIGS. 12 and 13. Therein the slipper is identical to that shown in FIGS. 10 and 11, except that the spaced dots 9 are replaced by a single bond 73 sometimes referred to as a bar seal. The bar seal, which is preferably in the form of an arc parallel to leading edge 7, extends from the center of leading edge 7 towards the sides of the slipper. Because the bar seal terminates inwardly of the sides of the slipper, a substantial amount of uncrushed and uncoalesced material remains between each of said sides and the ends of the bar seal. The presence of this unbonded material contributes to the bending resistance of the slipper. Also, the bar seal provides an area in which useful data may be imprinted, such as the trademark of the goods. Such data may be inscribed simultaneously with formation of the bar seal.

The embodiments of FIGS. 10–14 also show how sole 1 can be made of two layers. For example, there may be an outer foam layer 1 and an inner non-cellular layer 10, such as a woven nylon fabric which can provide additional comfort and ease in donning the slipper.

The slippers of the invention have the advantage that two sizes will fit most adults. In an exemplary large size slipper of the kind shown in FIGS. 1–3, 10, 11, 12 and 13, the overall length is approximately 29 centimeters while the length of the straight portions of the slipper sides is about 15 centimeters. The distance between such sides varies from a maximum of about 12 centimeters at the ball of the foot to a minimum of about 10 centimeters where they are tangent to the curve of the heel, the latter having a radius of about 5 centimeters. The radius of the very front of the toe of the slipper is also about 5 centimeters, which radius increases as the toe blends into the straight sides of the slipper. The sole, vamp and heel overlayer are each made of the same polyurethane foam material which is approximately 7 mm thick. The angle $\alpha$ is about 45°.

Figure 14:
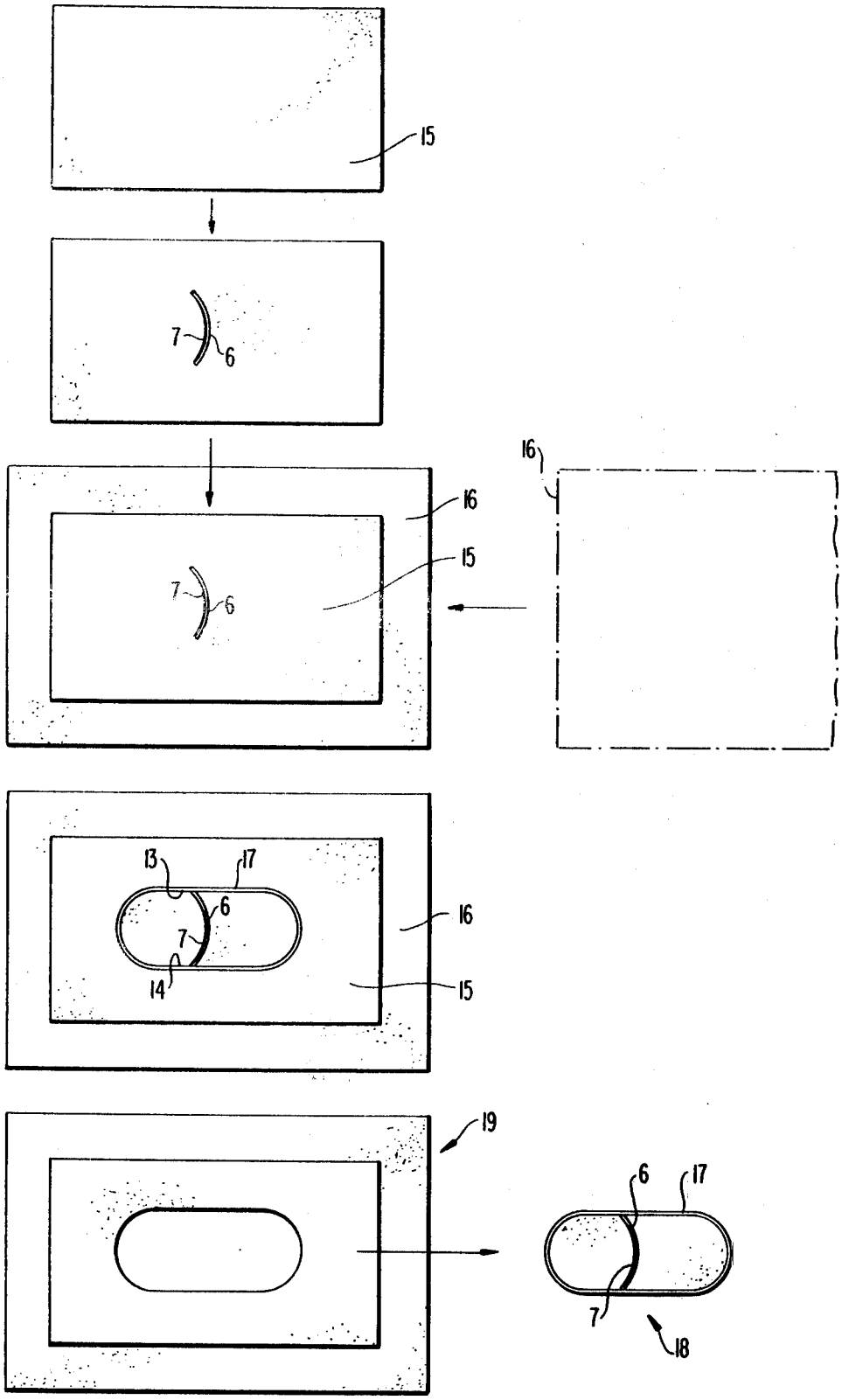
FIG. 14 is a schematic diagram illustrating a method by which slipper may be produced in accordance with the invention.

The method, illustrated in FIG. 14, includes cutting a first sheet of fusion bondable foam 15 to form a generally curved single cut for defining both vamp trailing edge 6 and overlayer forward edge 7. Then, a second sheet 16 of said material is brought face-to-face with sheet 15, and the sheets are squeezed together in a narrow region which is spaced outwardly from and surrounds the cut. This region has an outline conformable to the human foot.

While squeezed together, heat is applied to the sheets in said region at sufficient temperature, in sufficient amount and for sufficient time to cause coalescence or incipient melting, and permanent bonding together of the sheets within region 17. Usually the time required for bonding (also referred to as heat sealing) is measured in seconds or fractions thereof. Preferably, the cut or cuts which form the edges 6 and 7 terminate at the inner edges 13 and 14 of region 17, so that the cut or cuts do not traverse the region 17.

Separation of the completed slipper 18 from the waste material 19 may be performed at any time during or subsequent to the compression of the material and in any suitable manner such as by cutting, shearing, slicing or tearing away all of the material outward of the region in which bonding or sealing takes place, leaving all or at least a substantial portion of the seal intact and firmly attached to the material inward thereof. That portion of the first sheet which remains in the slipper thus produced comprises the vamp and the heel overlayer. The remaining portion of the second sheet 16 comprises the sole.

The method can be practiced with a variety of equipment and in different modes. For instance, the material may be advanced relatively continuously with the various fabricating steps being performed by "flying" punches, or cutters and dies. In a preferred embodiment, the material is advanced incrementally through equipment of the sort schematically illustrated in FIGS. 15 and 16, in which a first strip 40 unwinds from a feed roll 38 and is guided through rolls 41 and 42 which may be idler rolls or which may be driven in a manner to be explained hereinafter. From these rolls, the material passes to cutting station 43, where there is a punch 44, powered by any suitable reciprocating motor means, such as a hydraulic press cylinder 45. In cooperation with female die 46, situated below the material, punch 44 makes cuts in the material, each of which will define both the forward edge of a heel overlayer and the trailing edge of the vamp for the same slipper. However, two punches can be used to form two cuts for separately defining the vamp trailing edge and the heel overlayer forward edge, especially if such edges are to be spaced apart longitudinally in the completed slipper.

Figure 16:
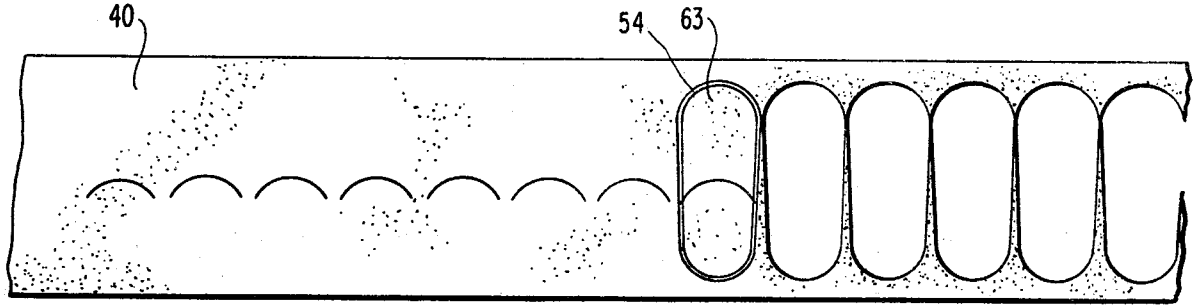
FIG. 16 is a fragmentary view of material under treatment in the method shown in FIG. 13.

Strip 40 is advanced through cutting station 43 incrementally, i.e. in a series of successive left to right longitudinal movements of equal length, each movement being followed by a short period in which the strip is stationary, during which punch 44 forms each of a series of longitudinally oriented cuts spaced along the length of the strip 40 as shown in FIG. 16.

In the present embodiment, the slippers are to be disposed transversely of strip 40. It is apparent however that slippers could also be formed lengthwise along said strip, necessitating an increase in the distance the strip is advanced between each actuation of punch 44. Whether the slippers are to be disposed longitudinally or transversely on said strip, the cuts may be punched in "gangs", i.e. several at a time using multiple punches. Optionally when using foam material, the punch may be provided with a heating element to sear the edges of the cuts.

Subsequent to forming the cuts, which are preferably longitudinal, strip 40 and second strip 48 are brought together. Strip 48 is preferably devoid of holes, except natural voids in the cell structure of the plastic foam material. It unwinds from supply roll 49 and is brought into face-to-face contact with strip 40 so that the transverse cuts are covered. Strips 40 and 48 are then moved together through severing and sealing station 58 where the strips are bonded together.

At severing and sealing station 50, there is a stationary lower sealing die 67 having an upwardly disposed horizontal die face 51. It is provided with a heating element 53 by means of which its temperature is raised to the fusion temperature of the thermoplastic foam material in strips 40 and 48. Directly above die face 51 and in registry therewith is the substantially identical, downwardly disposed horizontal die face 60 of upper sealing die 66. Die 66 is provided with a heating element 52.

Upper die 66 reciprocates vertically. By means of any suitable reciprocating motor means, 57, the upper die 66 is pressed firmly into contact with the strip 40 each time it comes to rest and is retracted before the material begins to move again.

A shearing type cutter 56 is associated with the upper die 66. The cutter is fitted closely above the entire periphery of die 66. Because the dies 66 and 67 have vertical walls and meet in substantially perfect registry, the cutter 56 can separate material clenched in the die from that lying outside of it. The cutter includes a base portion 70, attached to motor means 57, side walls 69 dependent from base 70 and a hardened cutting insert 68 secured in the lower edge of side walls 69. The insert 68 conforms to the exterior surface of side walls 75 and 76 of the upper and lower dies 66 and 67 and rings the upper die. The upper die is suspended within the cutter assembly with the aid of bolts 71 which pass through holes in cutter base 70 and threadably engage the upper die backing member 73. Springs 55 are wound about the bolts between base 70 and upper die backing member.

The normal condition of the dies, while the strips 40 and 48 are advancing, is open to permit the full thickness of both strips 40 and 48 to advance between them without catching.

When the strips 40 and 48 come to rest, the upper die closes down onto the lower die. The size and strength of the springs 55 are sufficiently great to insure that as the press closes, those portions of strips 40 and 48 which are between die faces 50 and 51 will be substantially completely crushed therebetween before the springs 55 yield to any significant extent under pressure from the motor 57. Thus effective operation of the cutter is prevented until the strips are thoroughly immobilized by being clenched between the die faces. Finally the cutter does function severing the material within the dies 66 and 67, while still clenched therein from the surrounding portions of the strips.

While the press is closed, the sealing operation also takes place in a narrow region of both strips 40 and 48 which corresponds in width to the width of die faces 50 and 51.

Sealing takes place when the thermoplastic foam strips are crushed together in region 64 while absorbing sufficient heat from dies 66 and 67 to reach the temperature at which the collapsed strips coalesce with one another to form a bond. Coalescence is ideally carried to the point that so much of the cellular structure of the strips as is between the die faces is virtually destroyed, leaving behind a pliable, noncellular seam 54 which remains in the final product. Bonding of the strip does not occur to any significant extent outside of region 54 because of the poor heat conductivity of the plastic foam.

It is not particularly critical whether severing takes place before or after the seal becomes completely developed. However, it is necessary that the dies remain closed long enough to ensure the formation of a good bond in the seam. This usually takes no more than a few seconds or fractions thereof.

Once both severing and sealing have been accomplished, the upper die is again opened by reversal of motor 57. As the dies open, the strips of thermoplastic material again advance, and the complete slippers 63 leave the press and are separated from the remaining portions of strips 40 and 48, which are illustrated in FIG. 16. These remaining portions constitute the waste products of the present method. When the strips 40 and 48 again come to rest, the above-described successive steps of closing the dies, forming a seal, severing waste material from the slipper, opening the dies, further advancing the material and bringing the material to rest are repeated again and again on a continuous basis.

In order to practice our method in apparatus of the character described above, it is necessary to utilize some form of automatic mechanism for advancing the material through cutting, sealing and severing stations. One desirable characteristic of a suitable advance mechanism is that it must bring the strips 40 and 48 to rest with the lengthwise cuts lying at the desired location within the die. In such a case, the strip 40 desirably comes to rest between the dies 66 and 67 with the longitudinal cuts centered in the dies, or as close thereto as practicable.

This requirement is partially fulfilled by placing the cutting station 63 and the severing and sealing station 50 at a proper distance from one another. They should be separated from one another by a distance which is approximately equal to some whole number multiple of the length of each incremental movement of the material as it advances over said path. For example, a multiple of three (3) has been used.

Also, it may be essential to control the length of the material itself. Polyurethane foam can be made in various gradiations of elasticity from very little or none to very stretchy. The type of foam ordinarily used in making articles such as the slippers of the present invention is sufficiently stretchy to change in shape and length when being pulled from one operation to another.

In a system in which all operating forces are fairly constant and in which the tensile properties of the material under treatment are equally constant, the material can be fed by pulling it through the system from the downstream end with a constant pulling force. However, we have found that the above conditions constitute an ideal situation which is seldom obtainable. Consequently, the preferred method of feeding involves both pushing the foam material into and pulling it out of the sealing mechanism, thus relieving it of deforming tensions. The objects of the present invention are attained in a measure by pushing and pulling the punched strip 40 while only pulling the lower strip 48. However, it is preferred that both the punched 40 and unpunched 48 strips be pushed as well as pulled. The pushing forces may be applied to the strips 40 and 48 separately, that is, before they come together. However, it is preferred that the strips be brought together prior to or practically at the same time as they are pushed towards the sealing and severing operation.

It is desirable that force be applied directly to the strips both ahead of and beyond the sealing and severing operation. This result can be obtained with the aid of any transport means which acts throughout some portion of the length of the strips, which portion traverses the cutting and sealing operation. Alternatively, means acting upon the strips at spaced points both ahead of and beyond the sealing and severing station may be used.

For instance, the "means acting upon the strips at spaced points both ahead of and beyond the sealing and severing station" can be a set of rollers. The set includes two pairs of rollers, a first pair, 58 and 59, ahead of said station and a second pair, 61 and 62, beyond said station. All of the rollers are driven by one common or several synchronized driving means so that each pair acts at the same rate, and moves through the same distance as the other. The rollers 41 and 42 may also be tied into the same driving system, if desired.

A complete system will also include suitable means for synchronizing the operation of the motors 45 and 57 with the work advancing mechanism. The main objective is to insure that both the transverse cut punch and the sealer/severing mechanism contact the material only when it is at rest. This objective can be easily attained through the use of electric rotary switch type timer clocks or electronic sequence timers, hydraulic pumps, solenoid valves, limit switches and other control apparatus with which those skilled in this art are already quite familiar.

The above preferred embodiment illustrates how the invention may readily be practiced with "thermal" heat sealing apparatus. Our invention may also be practiced with "electronic" sealing apparatus. These two types of apparatus, although they are both "thermal" in a sense, are distinguishable with regard to the manner of applying the heat to the work. In thermal sealing apparatus, the heat is transferred solely by direct conduction of heat units from a preheated die directly to the material which the die contacts under pressure. U.S. Pat. No. 2,425,388 is an example of this type.

In one example of the so-called electronic types of apparatus, the heat is developed in the material at least in part by subjecting the material to a high frequency alternating field. An example is found in U.S. Pat. No. 2,796,913. Electronic apparatus may include auxiliary heating means of the thermal type, whereby heat is applied to the material partly by conduction and partly by induction. For example, see U.S. Pat. No. 3,026,233.

During the sealing operation, the foam material is squeezed down to a fraction of its uncompressed thickness in the region where sealing takes place. Any effective means of compressing the material may be used. In the case of thermal sealing equipment, the member that transmits both pressure and heat to the material is ordinarily a metal-faced die corresponding to the shape of the desired seam. In electronic equipment, the members between which the sheets of foam are squeezed often comprise a die which is formed basically of metal, but has a facing of fiberglass reinforced heat-resistant polymer backed up by a layer of elastomeric material intermediate the metal and the facing.

The severing operation may take place while the work is in the grasp of the compression means or after it is released therefrom, the former mode of operation being preferred. The severing means employed may be manual or mechanical, the latter being preferred for reasons of uniformity of operation, speed and economy. Among the available alternative mechanical means are shearings such as the one illustrated above, shearing dies, cutting dies and cutting wires. Some of these alternative cutting means are illustrated in U.S. Pat. Nos. 3,015,601, 3,025,206, and 2,425,388.

The method of the invention also includes embodiments in which the first and second sheets are brought into face-to-face relationship in the sealing die before cutting the first sheet to form the vamp trailing edge and heel overlayer forward edge. While the sealing die is open, and the sheets are held stationary within it, a "tongue", i.e. an insertable member which carries the lower edge of a cutter(s) for forming said edges, may be temporarily inserted into the die and between the sheets by a horizontal motion from one end of the die. There is a cooperating cutting edge(s) in the upper portion of the sealing die. After the cut(s) is made by an upward movement of the tongue against the cutting edge in the upper die, the tongue is withdrawn, the sealing die closes, the perimeter bond of the slipper is completed, and the slipper is severed from the waste material.

As noted below, the "first" and "second" sheets or strips may be different but connected portions of a folded single sheet or strip of material. For example, two folds can be made in a single sheet or strip of material, the two folds being spaced apart by a distance approximately equal to the length of the sole. The central portion between the folds is used to form the sole. The two folded portions are used, respectively to form the heel overlayer and vamp, the latter being cut along one edge of the material to form the curved trailing edge of the vamp. Both folded portions may be folded down flat against the same face of the central portion in a sealing die and compressed in a region, similar to region 17 in FIG. 14, to simultaneously form the peripheral seam of the slipper and bond together the vamp, sole, and heel overlayer, following which the waste is severed.

Figure 15:
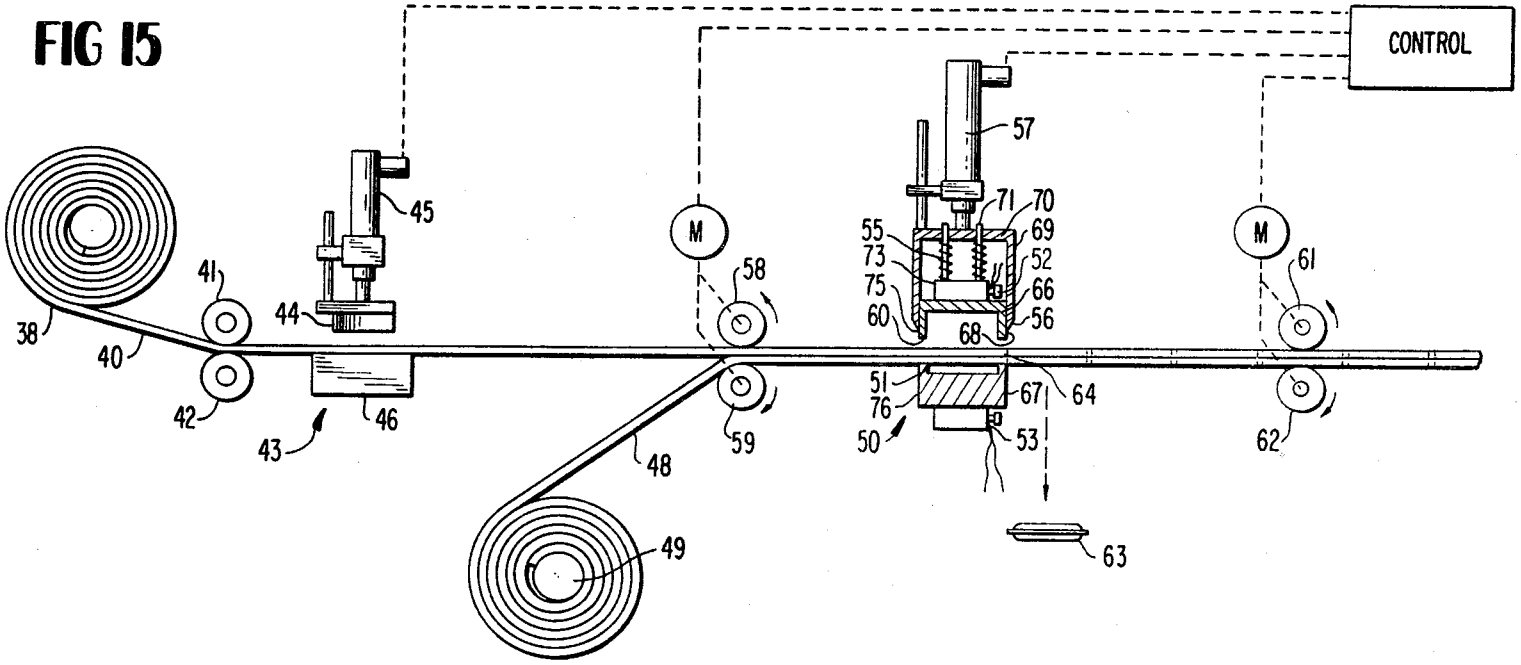
FIG. 15 is a partly sectional schematic diagram of a mechanized method by which slippers may be produced in accordance with the invention.

When practiced in the manner disclosed in FIGS. 14–16, the method of the invention produces slippers of the kind illustrated in FIGS. 1–3, in which the fore-portion of heel overlayer 3 is free of any attachment to sole 1. However, if one wishes to obtain the benefits of enhanced bending resistance resulting from such attachment, this may be accomplished in accordance with additional embodiments of the above-described method, and by modifying the apparatus of FIGS. 15 and 16 in any appropriate and desired manner. For example, the leading edge 7 of heel overlayer 3 may be secured to the sole 1 without fusion bonding. For instance, one may apply a small amount of fusible or settable liquid or paste adhesive to that portion of the underside of strip 40 which is to become the leading edge 7. Such application takes place while the strip 40 is held in cutting station 43, using a metering pump connected to a delivery tube which terminates in an open outlet in female die 46 adjacent the underside of the strip. When the die is opened and the adhesive-coated portion of strip 40 is advanced into contact with strip 48, the securing means will be formed before the outline of the heel overlayer is formed by die faces 60 and 51.

However, as indicated above, fusion bonding is the preferred technique for forming the securing means which attaches the fore-portion of the heel overlayer to the sole. When so doing, it is possible to form the securing means simultaneously with the peripheral seam S of the slipper. This may be done for instance by replacing upper and lower dies 66 and 67 of FIG. 15 with either the dot forming dies of FIGS. 17 and 18 or the bar seal forming dies of FIGS. 19 and 20.

Figure 18:
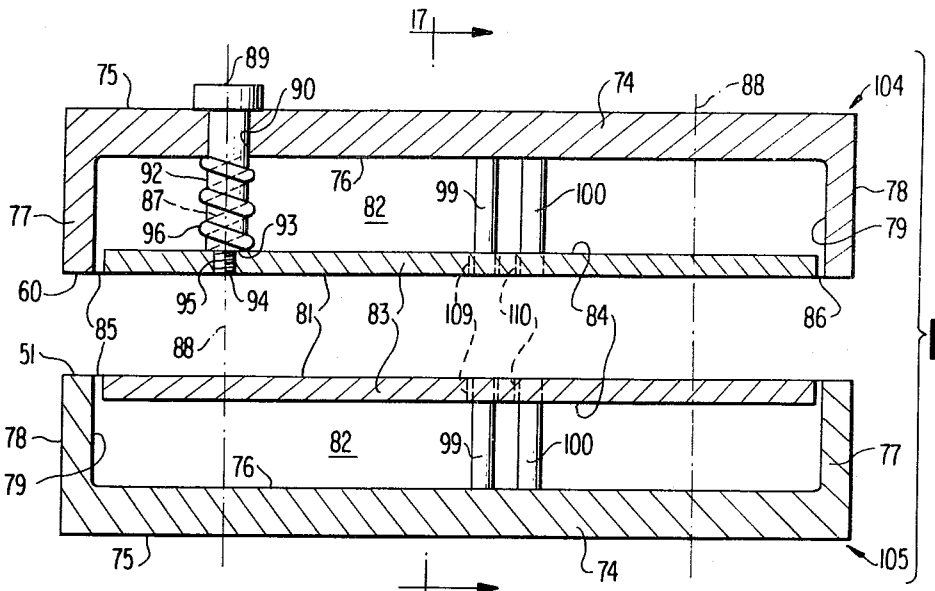
FIG. 18 is a vertical section taken along section line 18—18 of FIG. 17.
Figure 17:
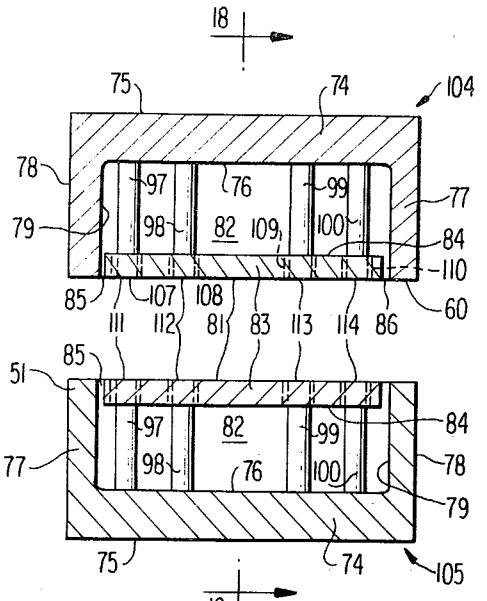
FIG. 17 is an enlarged drawing of sealing dies useable in the apparatus of FIG. 16.

FIGS. 17 and 18 disclose upper and lower sealing dies 104 and 105 which may be inserted in the apparatus of FIG. 15 in place of upper and lower sealing dies 66 and 67. Dies 104 and 105 each include base portions 74 having inner surfaces 76 and outer surfaces 75, the latter having sufficient contact with heating elements 53 and 52 to raise the dies 104 and 105 to the fusion temperature of the thermoplastic foam material in strips 40 and 48. Said dies also include sides 77 extending generally perpendicular to their bases 74 and having inner and outer surfaces 79 and 78 which terminate in die faces 60 and 51, the latter being identical to those of upper and lower dies 66 and 67.

The inner surfaces 76 and 79 of bases 74 and sides 77 define cavities 82 whose boundaries are planes in which die faces 60 and 51 are located. Within these cavities are stripper plates 83 having inner and outer surfaces 84 and 81 and peripheral edges whose outlines generally conform to the shape of the inner edges of die faces 60 and 51, edges 85 being separated from said die faces by small and preferably uniform spacings 86. Stripper plates 83 are adapted to retract a short distance into die cavities 82 when the dies are closed and to return to the fully extended position shown in FIGS. 17 and 18 when the dies open. When they extend, they push the fused material free of die faces 60 and 51. Such stripper plates may also be provided in the dies depicted in FIG. 15, if needed. In the embodiment of FIGS. 17 and 18, each stripper plate is secured for vertical reciprocation in die cavity 82 by mounting bolts, an example of which is mounting bolt 87 in FIG. 8, it being understood that like mounting bolts 87 are provided throughout FIGS. 17–20 at the locations indicated by center lines 88. However, the mounting bolts 87 have been omitted from FIGS. 17 and 19 to simplify the views.

Mounting bolts 87 are provided with threaded ends 94 which are screwed into threaded holes 95 of corresponding size in stripper plates 83 until shoulders 93 on the bolts engage stripper plate inner surfaces 84. Bolts 87 include cylindrical portions 92 which are of larger diameter their threaded ends 94 and which extend through cavities 82 and bores 90 in the die bases 74. Cylindrical portions 92 terminate in heads 89 which are of larger diameter than bores 90 and are situated outside the bases 74. Cylindrical portions 92 are of sufficient length so that the stripper plate outer surfaces 81 will be at the desired elevation relative to die faces 60 and 51 when heads 89 are in abutment with outer surface 75 of base 74 and the plates are fully extended. In general, it is preferred that the stripper plate outer surfaces 81 extend beyond or outside the elevation of die faces 60 and 51, when heads 89 abut the base outer surfaces 75. However, outer surfaces 81 can also be at the same elevation as the die faces or even a short distance inside the cavities 82.

Stripper plates 83 are moved to their retracted position (not shown) by the internal resistance against compression of the foam strips 40 and 48 which are grasped between the opposed plates of the upper and lower dies, as the latter close. To facilitate movement of plates 83 to retracted position, there is a loose fit between bolt cylindrical portions 92 and bores 90. In order to return the stripper plates 83 to their extended position, when the dies open, compression springs 96 are mounted around the cylindrical portions 92 with their ends bearing against the inner surfaces 76 and 84 of bases 74 and stripper plates 83. These springs have a small enough compression force so that the stripper plates can be moved by the internal compression resistance of the foam as the dies close.

FIGS. 17 and 18 disclose pins 97–100 of about 8 mm in diameter for forming the dots 9 disclosed in FIGS. 10 and 11. Said pins may be secured to the die bases 74 by any suitable arrangement such as for instance, a press fit in bores (not shown) of corresponding size in the bases 74. Pins 97–100 extend generally perpendicular to the bases through cavities 82 and corresponding apertures 107–110 in stripper plates 83. The ends 111–114 of said pins are flush with die faces 60 and 51. When die faces 60 and 51 close upon strips 40 and 48 to form the fusion bond S at the periphery of the slipper, the pin ends 111–114 in upper and lower dies 104 and 105 converge to compress the strips between said pins and form the spaced dot fusion bonds 9 of FIG. 10.

Figure 20:
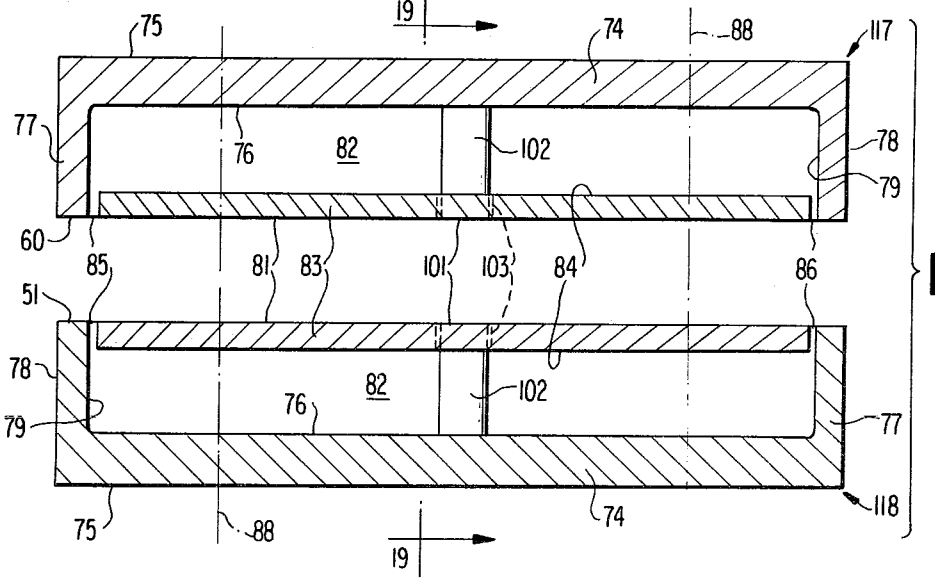
FIG. 20 is a vertical section taken along section line 20—20 of FIG. 19.
Figure 19:
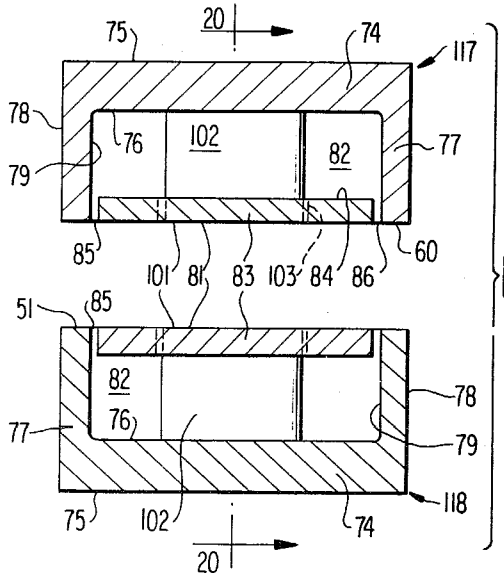
FIG. 19 is an alternative form of the sealing dies shown in FIG. 17.

FIGS. 19 and 20 disclose upper and lower sealing dies 117 and 118 which may be inserted in the apparatus of FIG. 15 in place of upper and lower sealing dies 66 and 67. Dies 117 and 118 are heated and operated in the same manner as dies 66, 67, 104 and 105. In general dies 117 and 118 are identical to dies 104 and 105 except that upper and lower pins 97–100 are replaced by upper and lower sealing bars 102, while aperatures 107–110 are replaced by stripper plate aperatures 103. The latter correspond in outline to the horizontal cross-section of sealing bars 102 and are spaced laterally therefrom by a short distance. Sealing bars 102 may be secured to the bases of dies 117 and 118 by any suitable arrangement, such as machine screws extending through holes in the die bases to threaded bores in the sealing bars. The sealing bars extend generally perpendicular to bases 74 through cavities 82 and corresponding aperatures 103 so that the inner ends 101 of the sealing bars are flush with die faces 60 and 51. These inner ends correspond in size and shape to the arcuate bar seal 73 of FIGS. 12 and 13. The arc may for example be about 38 mm across and 6 mm thick. When die faces 60 and 51 of dies 117 and 118 close upon strips 40 and 48 to form the fusion bond S, said sealing bars 102 converge to compress the strips between upper and lower sealing bar ends 101 to form the bar seal 73 of FIGS. 12 and 13.

From the above description of our methods, it is clear that they are sufficiently versatile to be practiced in a variety of types of equipment, only a few preferred representatives of which have been mentioned. Those skilled in the art will readily adapt our methods to types of apparatus not disclosed herein without departing from the steps of our methods. These methods have the advantages of producing articles with a minimum of handling of materials during and prior to production. They can be performed at a great rate of speed with a high degree of product uniformity and few rejects. They are readily adaptable to machinery in which ganged dies, sealing mechanisms and severing means are used to turn out a plurality of objects for each cycle of machine operation.

A more detailed description of a number of the process steps described herein and equivalents thereto can be found in U.S. Pat. Re 28,563, the disclosure of which is hereby incorporated herein by reference.

Definitions

Unless the context indicates to the contrary, the following definitions apply to the terms employed in this specification and the accompanying claims:

Pliant

Having a sufficiently small modulus of elasticity and/or a sufficiently thin cross-section so as to require only a relatively small force for a given amount of deformation.

Stiff

Requiring a relatively large force for a given amount of deformation.

Flexible

Capable of undergoing substantial physical deformation under applied force without structural damage or distress.

Elastic

Capable of deforming on application of force and returning to nearly the original shape on the removal of the force.

Longitudinal axis

As applied to the slipper, a longitudinal line extending from the toe to the heel; such term does not imply that the slipper must be symmetrical.

Adjacent

As applied to the positional relationships of the fusion bonded seam and/or corresponding edges of component parts of the slipper, means in, on, or near.

Parallel

Is used in a general sense to indicate that lines extend in a given direction or directions while maintaining approximately the same distance from one another, and does not necessarily imply straight lines.

Extends to

As applied to the approaching of the fusion bonded seams by the outer portions of the vamp's trailing edge, this term means: to approach and almost meet, without actually meeting; to approach and meet; or to approach and cross.

Intersect or Intersection

Refers to intersection of a seam at the side of the slipper with either the vamp trailing edge itself or with a line extended from the outer terminal portion of said trailing edge.

Forming

As applied to the method of the present invention, this term means any effective step or steps capable of forming an edge, such as cutting, molding, shearing, punching and the like.

First and Second Sheet

Although the literal terms "first sheet" and "second sheet" may denote the presence of two sheets in some contexts, those terms are used herein to refer also to separate portions of a single sheet.

Bringing Said First Sheet and Said Second Sheet Into Face-to-Face Contact

This term includes bringing separate sheets together or folding over a double-sized single sheet to produce the same result.

Fusing

Means any process which produces bonding by fusion of the material.

Separating

Includes any mode of parting the completed slipper from excess material.

Fore-Portion

As applied to the heel over-layer, refers to the forward half of its length.

Unless the context indicates to the contrary, such terms as "front", "rear", "side", "longitudinal", "transverse", "inward", "outward", "upward", "forward-most" and "rearmost", "trailing" and "leading" are intended to give orientation relative to the wearer's foot.

What is claimed is:

1. A scuff-type slipper, the shape of which changes elastically between a wearing position and a non-wearing position, being stretched elastically in wearing position in a plane perpendicular to the slipper longitudinal axis at and around the instep of the wearer's foot, and having no heel structure extending up the rear of the wearer's heel, and, in non-wearing position, being relatively flat and contracted as compared to its wearing position, said slipper comprising:

a sole with front, side and rear edges which, in combined outline, approximate the outline of the human foot, said sole being of material which has longitudinal flexibility and is sufficiently pliant in longitudinal bending, that it would be susceptible to turning under of its rear portion when in use, and having sufficient width and transverse pliant flexibility, that it is capable of bending upwardly at the sides of the wearer's instep on both sides of the slipper;

a heel overlayer extending forwardly from adjacent the heel of the slipper over the upper surface of the sole for about ¼ to about ½ the total length from the heel to the toe of the slipper, measured along its longitudinal axis, said overlayer having rear and side edges and a transverse leading edge, said overlayer being joined to the sole at least along and adjacent to the side edges of the sole and overlayer by a fusion bonded or seams, said transverse leading edge extending to an intersection with the fusion bonded seams at each side of the slipper, said overlayer having sufficient transverse pliant flexibility, that it is capable of bending upwardly at its lateral edges;

a vamp which extends rearwardly over the upper surface of the sole from adjacent the toe of the slipper to a position which is at least about ½ of the length from the toe to the heel of the slipper, measured along its longitudinal axis, said vamp having front and side edges and a transverse trailing edge, said vamp being joined to the sole at least along and adjacent to the side edges of the sole and vamp by a fusion bonded or seams, said trailing edge extending to an intersection with the fusion bonded seam at the sides of the slipper, said vamp being of pliantly elastic material to develop, when stretched by insertion of the wearer's foot, an internal elastic tension in the vamp having an upward and inward transverse component of force which is transmitted to the sole and heel overlayer through the fusion bonded seams, said vamp having sufficient thickness and modulus of elasticity in tension to cause lifting of the side edges of the sole above the upper surface of the sole along its longitudinal axis, thereby inducing a curvature of the sole in a plane perpendicular to the slipper axis in the vicinity of the wearer's instep for increasing the stiffness of the slipper against longitudinal bending and reducing the tendency of the rear portion of the slipper to fold under in use.

2. A slipper according to claim 1 wherein the position to which the vamp extends is more than about ½ to about ¾ of the length from the toe to the heel of the slipper.

3. A slipper according to claim 1 wherein at least the outer portions of the vamp trailing edge, viewed from above with the slipper flattened in non-wearing position, extend rearwardly and outwardly to said intersections, and said position is defined as the mean of the distances from the toe to (a) the forward-most and (b) the rear-most projections of the trailing edge.

4. A slipper according to claim 1 wherein at least the outer portions of the vamp trailing edge, viewed from above with the slipper flattened in non-wearing position, extend to said intersections at an acute angle with the respective seam or seams to inhibit tearing of the vamp, sole or bond in the vicinity of said intersection.

5. A slipper according to claim 1 wherein said overlayer leading edge and said vamp trailing edge, viewed from above with the slipper flattened in non-wearing position, substantially coincide with one another.

6. A slipper according to claim 1 wherein said vamp and heel overlayer are portions of the same piece of material.

7. A slipper according to claim 6 wherein said portions are not severed from one another at said intersections.

8. A slipper according to claim 1 wherein a common seam joins the vamp and heel overlayer to the sole on the right side of the slipper and a common seam joins the vamp and heel overlayer to the sole on the left side of the slipper.

9. A slipper according to claim 1 wherein the front edges of the sole and vamp are joined by a fusion bonded seam.

10. A slipper according to claim 1 wherein the rear edges of the sole and heel overlayer are joined by a fusion bonded seam.

11. A slipper according to claim 1 wherein the front edges of the sole and vamp and the rear edges of the sole and heel overlayer are respectively joined by a fusion bonded seam.

12. A slipper according to claim 1 wherein the sole, vamp, and heel overlayer are joined by a seam extending around the entire periphery of the slipper.

13. A slipper according to claim 12 wherein said seam is a substantially continuous heat seal of crushed, coalesced material around substantially the entire periphery of the slipper.

14. A slipper according to claim 1 wherein said heel overlayer is secured to said sole only at the periphery of said overlayer.

15. A slipper according to claim 1 wherein the entire periphery of the side and rear edges of the heel overlayer is secured to said sole.

16. A slipper according to claim 1 wherein the fore-portion of the heel overlayer is secured to the upper side of the sole for bracing the heel portion of the slipper against folding under.

17. A slipper according to claim 16 wherein at least the outer portions of said vamp trailing edge extend rearwardly and outwardly to said intersections, and said fore-portion is secured to the sole by connecting means forward of a line connecting said intersections.

18. A slipper according to claim 16 wherein said fore-portion is secured to the sole by one or more fusion bonds along the heel overlayer forward edge.

19. A slipper according to claim 1 wherein crushed, coalesced fusion bonded material in said heel overlayer and sole secure the fore-portion at the heel overlayer to the sole, said crushed, coalesced material and uncrushed, uncoalesced material being distributed along a line extending across the slipper from one side of said slipper to ther other, the amount of crushed, coalesced material along said line being an amount, up to about 50% of the material along said line, which is sufficient to maintain the integrity of the fusion bonding of the sole and heel overlayer during normal use of said slipper.

20. A method of manufacturing slippers comprising: (A) providing a first sheet of fusion bondable polymeric sheeting material from which is to be formed a vamp and a heel overlayer; (B) providing a second sheet of fusion bondable polymeric sheeting material, from which is to be formed a sole that is to be united with the vamp and heel overlayer to form an elongated slipper having a toe, a heel, and a longitudinal axis extending therebetween; (C) forming a cut in said first sheet of material transverse to said longitudinal axis for defining the trailing edge of the vamp; (D) forming a cut in said first sheet transverse to said longitudinal axis for defining the leading edge of the heel overlayer; (E) bringing said first and second sheets together in face-to-face relationship; (F) in a sealing operation, exerting firm pressure on the exposed faces of said sheets in at least one narrow region, having an elongated outline generally conformable to the human foot, said outline being elongated in the direction of said longitudinal axis and generally transverse to the said cut or cuts, said cut or cuts extending to said region; (G) raising the temperature of said sheets within said region to the temperature at which said sheets will adhere to one another within said region, maintaining said temperature for a time sufficient to ensure the formation of a permanent bond between said sheets in said region; and (H) separating a slipper from material lying outside of said region.

21. The method of claim 20 wherein the same transverse cut defines both the trailing edge of the vamp and the leading edge of the heel overlayer.

22. The method of claim 20 wherein the cut or cuts formed in steps (C) and (D) are terminated at the inner edges of said region.

23. The method of claim 20 wherein the fore portion of the heel overlayer is secured to the upper surface of the sole simultaneous with fusing of the sheets to one another in steps (F) and (G).

24. The method of claim 20 which comprises forming a plurality of said slipper by: (A) providing said first sheet in the form of an elongated strip of thermoplastic material; (B) providing said second sheet in the form of an elongated strip of thermoplastic material; (C) advancing said first strip of material in the direction in which it is elongated through a means for forming cuts oriented longitudinally relative to the strip at intervals which are spaced longitudinally along said strip for defining the trailing edges of the vamp portions of the slippers; (D) advancing said first strip of material in the direction in which it is elongated through a means for forming cuts oriented longitudinally relative to the strip at intervals which are spaced longitudinally along said strip for defining the leading edges of the heel overlayer portions of the slippers; (E) forming said cuts at equally spaced intervals of length along said strip; (F) bring said first and second strips into face-to-face contact with one another; and (G) advancing said strips longitudinally and repetitively pressing and fusion bonding said strips together at said equally spaced intervals of length.

25. The method of claim 24 wherein said first and second strips together are advanced through a cutting and sealing operation by pushing said strips toward said operation from one side thereof and pulling or withdrawing said strips from the other side of said operation, said pushing and pulling being applied at the same time and over equal distances.

26. The method of claim 24 wherein said strips are advanced incrementally.

27. The method of claim 24 wherein the trailing edge of the vamp and the leading edge of the heel overlayer of each slipper are formed simultaneously by the same cut.

28. The method of claim 20 wherein the first sheet and said second sheet are brought together after cutting the first sheet to form the vamp trailing edge and heel overlayer leading edge.

29. The method of claim 24 wherein said first strip and said second strip are brought together after cutting the first strip to form the vamp trailing edge and heel overlayer leading edge.

30. A method of forming a scuff-type slipper by forming sole, vamp and heel overlayer components relative to an axis extending in a pre-determined direction in fusion bondable polymeric sheeting material, said axis corresponding to the longitudinal axis of the slipper which is to be produced from said material, said method comprising:

(A) providing a first sheet of said material from which to form said vamp and heel overlayer, said sheet being of sufficient size to form a vamp long enough to extend along said axis from adjacent the toe of the slipper to a position which is at least about half the distance from the toe to the heel of the slipper, and to form a heel overlayer long enough to extend along said axis from adjacent the heel of the slipper to a position which is about one-fourth to about one-half the length from the heel to the toe of the slipper;

(B) providing a second sheet of said material from which to form said sole, said sheet being of sufficient size to form a sole long enough to extend along said axis from the toe to the heel of the slipper, said material being flexible and sufficiently pliant along said axis so that the heel portion of the slipper would be susceptible to turning under when in use, and said material being flexible and sufficiently pliant transversely of said axis so that it would be capable of bending upwardly;

(C) forming a cut in said first sheet transverse to said axis for defining the trailing edge of the vamp;

(D) forming a cut in said first sheet transverse to said axis for defining the leading edge of the heel overlayer;

(E) bringing said first and second sheets together in face-to-face relationship;

(F) pressing said first and second sheets together in at least one narrow region which extends along on outline that is elongated in the direction of said axis and generally transverse to said cut or cuts, said outline being generally comformable to the human foot and extending along the toe, sides and heel of the slippers to be formed therefrom, the area encompassed by said outline being of sufficient width in relation to the size of the foot on which the slipper is to be worn so that the resultant sole can bend upwardly at the sides of the wearer's instep on both sides of the slipper, said first sheet being positioned during said pressing with said cut or cuts extending to intersections with said region, with the cut defining said trailing edge being positioned at a distance from the toe of the slipper outline which is at least about one half the length of the slipper, and with the cut defining said leading edge being positioned at an interval from the heel of the slipper outline which is about one-fourth to about one-half the length of the slipper;

(G) during said pressing, raising the temperature of said sheets within said region to the temperature at which said sheets will fusion bond to one another within said region and maintaining said temperature for a time sufficient to insure the formation of a fusion bonded seam or seams between said sheets in said region; and (H) separating a slipper from the material lying outside of said outline.

31. The method of claim 30 wherein both the trailing edge of the vamp and the leading edge of the heel overlayer are formed by the same transverse cut.

32. The method of claim 30 wherein the cut or cuts formed in said first sheet are formed so that they terminate at the inner edges of said region.

33. The method of claim 30 wherein the fore-portion of the heel overlayer is fusion bonded to the sole simultaneous with fusion bonding of the sheet in said region.

34. A scuff-type slipper, the shape of which changes elastically between a wearing position and a non-wearing position, being stretched elastically in wearing position in a plane perpendicular to the slipper longitudinal axis at and around the instep of the wearer's foot, and having no heel structure extending up the rear of the wearer's heel, and, in non-wearing position, being relatively flat and contracted as compared to its wearing position, said slipper comprising:

a sole with front, side and rear edges which, in combined outline, approximate the outline of the human foot, said sole being of material which has longitudinal flexibility and is sufficiently pliant in longitudinal bending, that it would be susceptible to turning under of its rear portion when in use, and having sufficient width and transverse pliant flexibility, that is capable of bending upwardly at the sides of the wearer's instep on both sides of the slipper;

a heel overlayer extending forwardly from adjacent the heel of the slipper over the upper surface of the sole for about ¼ to about ½ the total length from the heel to the toe of the slipper, measured along its longitudinal axis, said overlayer having rear and side edges and a transverse leading edge, said overlayer being joined to the sole at least along and adjacent to the side edges of the sole and overlayer by a fusion bonded seam or seams, said transverse leading edge extending to an intersection with the fusion bonded seam(s) at each side of the slipper, said overlayer having sufficient transverse pliant flexibility, that it is capable of bending upwardly at its lateral edges;

a vamp which extends rearwardly over the upper surface of the sole from adjacent the toe of the slipper to a position which is at least about ½ to about ¾ of the length from the toe to the heel of the slipper, measured along its longitudinal axis, and vamp having front and side edges and a transverse trailing edge, said vamp being joined to the sole at least along and adjacent to the side edges of the sole and vamp by a fusion bonded seam or seams, said trailing edge extending to an intersection with the fusion bonded seam(s) at the sides of the slipper, said heel overlayer and vamp being portions of the same piece of material, which portions are not severed but integrally connected with one another in said seam(s), said vamp being of pliantly elastic material to develop, when stretched by insertion of the wearer's foot, an internal elastic tension in the vamp having an upward and inward transverse component of force which is transmitted to the sole and heel overlayer through the fusion bonded seam(s), said vamp having sufficient thickness and modulus of elasticity in tension to cause lifting of the side edges of the sole above the upper surface of the sole along its longitudinal axis, thereby inducing a curvature of the sole in a plane perpendicular to the slipper axis in the vicinity of the wearer's instep for increasing the stiffness of the slipper against longitudinal bending an reducing the tendency of the rear portion of the slipper to fold under in use.

35. A slipper according to claim 34 wherein at least the outer portions of the vamp trailing edge, viewed from above with the slipper flattened in non-wearing position, extend rearwardly and outwardly to said intersections, and said position is defined as the mean of the distances from the toe to (a) the forward-most and (b) the rear-most projections of the trailing edge.

36. A slipper according to claim 34 wherein said overlayer leading edge and said vamp trailing edge, viewed from above with the slipper flattened in non-wearing position, substantially coincide with one another.

37. A slipper according to claim 34 wherein a common seam joins the vamp and heel overlayer to the sole on the right and left sides of the slipper.

38. A slipper according to claim 34 wherein said heel overlayer is secured to said sole only at the periphery of said overlayer.

39. A slipper according to claim 34 wherein the fore-portion of the heel overlayer is secured to the upper side of the sole for bracing the heel portion of the slipper against folding under.

40. A slipper according to claim 39 wherein at least the outer portions of said vamp trailing edge extend rearwardly and outwardly to said intersections, and said fore-portion is secured to the sole by connecting means forward of a line connecting said intersections.

41. A slipper according to claim 39 wherein said fore-portion is secured to the sole by one or more fusion bonds along the heel overlayer forward edge.

42. A slipper according to claim 34 wherein the fore-portion of the heel overlayer is secured to the sole by crushed, coalesced fusion bonded material in said heel overlayer and sole, said crushed, coalesced material and uncrushed, uncoalesced material being distributed along a line extending across the slipper from one side of said slipper to the other, the amount of crushed, coalesced material along said line being an amount, up to about 50% of the material along said line, which is sufficient to maintain the integrity of the fusion bonding of the sole and heel overlayer during normal use of said slipper.

* * * * *